US009099096B2

(12) United States Patent
Yoo et al.

(10) Patent No.: US 9,099,096 B2
(45) Date of Patent: Aug. 4, 2015

(54) SOURCE SEPARATION BY INDEPENDENT COMPONENT ANALYSIS WITH MOVING CONSTRAINT

(75) Inventors: Jaekwon Yoo, Foster City, CA (US); Ruxin Chen, Redwood City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 607 days.

(21) Appl. No.: 13/464,848

(22) Filed: May 4, 2012

(65) Prior Publication Data

US 2013/0294608 A1 Nov. 7, 2013

(51) Int. Cl.
*G10L 21/02* (2013.01)
*G10L 21/0272* (2013.01)

(52) U.S. Cl.
CPC ..... *G10L 21/0272* (2013.01)

(58) Field of Classification Search
USPC ..... 704/226–228
See application file for complete search history.

(56) References Cited

U.S. PATENT DOCUMENTS

| | | | | |
|---|---|---|---|---|
| 6,266,636 | B1 | 7/2001 | Kosaka et al. | |
| 6,622,117 | B2 * | 9/2003 | Deligne et al. | 702/190 |
| 7,797,153 | B2 | 9/2010 | Hiroe | |
| 7,912,680 | B2 | 3/2011 | Shirakawa | |
| 7,921,012 | B2 | 4/2011 | Fujimura et al. | |
| 8,249,867 | B2 * | 8/2012 | Cho et al. | 704/233 |
| 2007/0021958 | A1 | 1/2007 | Visser et al. | |
| 2007/0185705 | A1 * | 8/2007 | Hiroe | 704/200 |
| 2007/0280472 | A1 | 12/2007 | Stokes, III et al. | |
| 2008/0107281 | A1 * | 5/2008 | Togami et al. | 381/66 |
| 2008/0122681 | A1 | 5/2008 | Shirakawa | |
| 2008/0219463 | A1 * | 9/2008 | Liu et al. | 381/66 |
| 2008/0228470 | A1 * | 9/2008 | Hiroe | 704/200 |
| 2009/0089054 | A1 | 4/2009 | Wang et al. | |
| 2009/0222262 | A1 * | 9/2009 | Kim et al. | 704/231 |
| 2009/0304177 | A1 | 12/2009 | Burns et al. | |
| 2009/0310444 | A1 * | 12/2009 | Hiroe | 367/125 |
| 2011/0261977 | A1 * | 10/2011 | Hiroe | 381/119 |
| 2012/0128166 | A1 * | 5/2012 | Kim et al. | 381/58 |
| 2013/0144616 | A1 | 6/2013 | Bangalore | |
| 2013/0156222 | A1 * | 6/2013 | Lee et al. | 381/93 |
| 2013/0231923 | A1 * | 9/2013 | Zakarauskas et al. | 704/205 |
| 2013/0272548 | A1 * | 10/2013 | Visser et al. | 381/122 |
| 2013/0297298 | A1 | 11/2013 | Yoo et al. | |

OTHER PUBLICATIONS

Notice of Allowance for U.S. Appl. No. 13/464,828, dated Aug. 20, 2014.
Notice of Allowance for U.S. Appl. No. 13/464,833, dated Aug. 21, 2014.

(Continued)

*Primary Examiner* — Douglas Godbold
(74) *Attorney, Agent, or Firm* — Joshua D. Isenberg; JDI Patent

(57) ABSTRACT

Methods and apparatus for signal processing are disclosed. Source separation can be performed to extract moving source signals from mixtures of source signals by way of independent component analysis. Source motion is modeled by direct to reverberant ratio in the separation process, and independent component analysis techniques described herein use multivariate probability density functions to preserve the alignment of frequency bins in the source separation process.

40 Claims, 5 Drawing Sheets

(56) References Cited

OTHER PUBLICATIONS

Benesty, J.; Amand, F.; Gilloire, A.; Grenier, Y., "Adaptive filtering algorithms for stereophonic acoustic echo cancellation," Acoustics, Speech, and Signal Processing, 1995. ICASSP-95., 1995 International Conference on , vol. 5, no., pp. 3099,3102 vol. 5, May 9-12, 1995.
Benesty, Jacob, Pierre Duhamel, and Yves Grenier. "Multi-Channel Adaptive Filtering Applied to Multi-Channel Acoustic Echo Cancellation." (1996): n. pag. Print.
Benesty, Jacob, Thomas Gansler, Yiteng Arden Huang, and Markus Rupp. "Adaptive Algorithsm for MIMO Acoustic Echo Cancellation." (2004): 119-47. Print.
Buchner, H.; Kellermann, W., "A Fundamental Relation Between Blind and Supervised Adaptive Filtering Illustrated for Blind Source Separation and Acoustic Echo Cancellation," Hands-Free Speech Communication and Microphone Arrays, 2008. HSCMA 2008 , vol., No., pp. 17,20, May 6-8, 2008.
Buchner, Herbert, "Acoustic Echo Cancellation for Multiple Reproduction Channels: From First Principles to Real-Time Solutions," Voice Communication (SprachKommunikation), 2008 ITG Conference on , vol., No., pp. 1,4, Oct. 8-10, 2008.
H.Sawada, R.Mukai, S.Araki and S.Makino, "Solving Permutation and Circularity problem in Frequency-Domain Blind Source Separation," Proc. International Conf. on ICA 2004, Japan.
Hao, Jiucang, Intae Lee, Te-Won Lee, and Terrence J. Sejnowski. "Independent Vector Analysis for Source Separation Using a Mixture of Gaussians Prior." Neural Computation 22.6 (2010): 1646-673. Print.
Hioka, Y.; Niwa, K.; Sakauchi, S.; Furuya, K.; Haneda, Y., "Estimating Direct-to-Reverberant Energy Ratio Using D/R Spatial Correlation Matrix Model," Audio, Speech, and Language Processing, IEEE Transactions on , vol. 19, No. 8, pp. 2374,2384, Nov. 2011.
Huillery, J.; Millioz, F.; Martin, N., "On the Probability Distributions of Spectrogram Coefficients for Correlated Gaussian Process," Acoustics, Speech and Signal Processing, 2006. ICASSP 2006 Proceedings. 2006 IEEE International Conference on , vol. 3, No., pp. III,III, May 14-19, 2006.
Hyvarinen, Aapo, and Erkki Oja. "Independent Component Analysis: Algorithms and Applications." Neural Networks (2000): 411-30. Print.
Joho, Marcel, Heinz Mathis, and Russel H. Lambert. "Overdetermined Blind Source Separation: Using More Sensors Than Source Signals in a Noisy Mixture." Independent Component Analysis and Blind Signal Separation (2000): 81-86. Print.
Kawanabe, Motoaki, and Noboru Murata. "Independent Component Analysis in the Presence of Gaussian Noise." (2000): n. pag. Print.
Klumpp, V.; Hanebeck, U.D., "Bayesian estimation with uncertain parameters of probability density functions," Information Fusion, 2009. FUSION '09. 12th International Conference on , vol., No., pp. 1759,1766, Jul. 6-9, 2009.
Lee, Seonjoo, Haipeng Shen, Young Truong, Mechelle Lewis, and Xuemei Huang. "Independent Component Analysis Involving Autocorrelated Sources With an Application to Functional Magnetic Resonance Imaging." (2011): n. pag. Print.
Li, Huxiong, and Fan Gu. "A Blind Separation Algorithm for Speech in Strong Reverberation." Journal of Computational Information Systems (2010): n. pag. Print.
Malek, Jiri. "Blind Audio Source Separation via Independent Component Analysis." (2010): n. pag. Print.
Masaru Fujieda and Takahiro Murakami and Yoshihisa Ishida "An Approach to Solving a Permutation Problem of Frequency Domain Independent Component Analysis for Blind Source Separation of Speech Signal" , International Journal of Biological and Life Sciences 1:4 2005.
Mukai, Ryo, Hiroshi Sawada, Shoko Araki, and Shoji Makino. "Real-Time Blind Source Separation for Moving Speech Signals." (2005): n. pag. Print.
Ngoc, Duong Quang K., Park Chul, and Seung-Hyon Nam. "An Acoustic Echo Canceller Combined With Blind Source Separation."
R. Mukai, H. Sawada, S. Araki, and S. Makino, "Real-Time blind source separation for moving speakers using blockwise ICA and residual crosstalk subtraction", Proc. Int. Symp. Independent Component Analysis Blind Signal Separation (ICA) , pp. 975-980 2003.
Reynolds, Douglas A. "Gaussian Mixture Models." (2009): 659-663.
Russell, Iain T., Jiangtao Xi, and Alfred Merlins. "Time Domain Blind Separation of Nonstationary Convolutively Mixed Signals." (2005): n. pag. Print.
Sawada, H.; Mukai, Ryo; Araki, S.; Makino, S., "A robust and precise method for solving the permutation problem of frequency-domain blind source separation," Speech and Audio Processing, IEEE Transactions on , vol. 12, No. 5, pp. 530,538, Sep. 2004.
Souden, M.; Zicheng Liu, "Optimal joint linear acoustic echo cancelation and blind source separation in the presence of loudspeaker nonlinearity," Multimedia and Expo, 2009, ICME 2009. IEEE International Conference on , vol., No., pp. 117,120, Jun. 28, 2009-Jul. 3, 2009.
U.S. Appl. No. 13/464,828, entitled "Source Separation by Independent Component Analysis in Conjunction With Source Direction Information" to Jaekwon Yoo, filed May 4, 2012.
U.S. Appl. No. 13/464,833, entitled "Source Separation Using Independent Component Analysis With Mixed Multi-Variate Probability Density Function" to Jaekwon Yoo, filed May 4, 2012.
U.S. Appl. No. 13/464,842, entitled "Source Separation by Independent Component Analysis in Conjuction With Optimization of Acoustic Echo Cancellation" to Jaekwon Yoo, filed May 4, 2012.
Yensen, T.; Goubran, R., "An acoustic echo cancellation structure for synthetic surround sound," Acoustics, Speech, and Signal Processing, 2001. Proceedings. (ICASSP '01). 2001 IEEE International Conference on , vol. 5, No., pp. 3237,3240 vol. 5, 2001.
Non-Final Office Action for U.S. Appl. No. 13/464,828, dated Apr. 30, 2014.
Non-Final Office Action for U.S. Appl. No. 13/464,833, dated May 15, 2014.
Non-Final Office Action for U.S. Appl. No. 13/464,842, dated Jul. 22, 2014.
Final Office Action for U.S. Appl. No. 13/464,842, dated Feb. 3, 2015.

* cited by examiner

SOURCE SEPARATION BY INDEPENDENT COMPONENT ANALYSIS WITH MOVING CONSTRAINT

CROSS-REFERENCE TO RELATED APPLICATIONS

This application is related to commonly-assigned, co-pending application Ser. No. 13/464,833, to Jaekwon Yoo and Ruxin Chen, entitled SOURCE SEPARATION USING INDEPENDENT COMPONENT ANALYSIS WITH MIXED MULTI-VARIATE PROBABILITY DENSITY FUNCTION, filed the same day as the present application, the entire disclosures of which are incorporated herein by reference. This application is also related to commonly-assigned, co-pending application Ser. No. 13/464,842, to Jaekwon Yoo and Ruxin Chen, entitled SOURCE SEPARATION BY INDEPENDENT COMPONENT ANALYSIS IN CONJUNCTION WITH OPTIMIZATION OF ACOUSTIC ECHO CANCELLATION, filed the same day as the present application, the entire disclosures of which are incorporated herein by reference. This application is also related to commonly-assigned, co-pending application Ser. No. 13/464,828, to Jaekwon Yoo and Ruxin Chen, entitled SOURCE SEPARATION BY INDEPENDENT COMPONENT ANALYSIS IN CONJUNCTION WITH SOURCE DIRECTION INFORMATION, filed the same day as the present application, the entire disclosures of which are incorporated herein by reference.

FIELD OF THE INVENTION

Embodiments of the present invention are directed to signal processing. More specifically, embodiments of the present invention are directed to audio signal processing and source separation methods and apparatus utilizing independent component analysis (ICA) in conjunction with a moving constraint.

BACKGROUND OF THE INVENTION

Source separation has attracted attention in a variety of applications where it may be desirable to extract a set of original source signals from a set of mixed signal observations.

Source separation may find use in a wide variety of signal processing applications, such as audio signal processing, optical signal processing, speech separation, neural imaging, stock market prediction, telecommunication systems, facial recognition, and more. Where knowledge of the mixing process of original signals that produces the mixed signals is not known, the problem has commonly been referred to as blind source separation (BSS).

Independent component analysis (ICA) is an approach to the source separation problem that models the mixing process as linear mixtures of original source signals, and applies a de-mixing operation that attempts to reverse the mixing process to produce a set of estimated signals corresponding to the original source signals. Basic ICA assumes linear instantaneous mixtures of non-Gaussian source signals, with the number of mixtures equal to the number of source signals. Because the original source signals are assumed to be independent, ICA estimates the original source signals by using statistical methods extract a set of independent (or at least maximally independent) signals from the mixtures.

While conventional ICA approaches for simplified, instantaneous mixtures in the absence of noise can give very good results, real world source separation applications often need to account for a more complex mixing process created by real world environments. A common example of the source separation problem as it applies to speech separation is demonstrated by the well-known "cocktail party problem," in which several persons are speaking in a room and an array of microphones are used to detect speech signals from the separate speakers. The goal of ICA would be to extract the individual speech signals of the speakers from the mixed observations detected by the microphones; however, the mixing process may be complicated by a variety of factors, including noises, music, moving sources, room reverberations, echoes, and the like. In this manner, each microphone in the array may detect a unique mixed signal that contains a mixture of the original source signals (i.e. the mixed signal that is detected by each microphone in the array includes a mixture of the separate speakers' speech), but the mixed signals may not be simple instantaneous mixtures of just the sources. Rather, the mixtures can be convolutive mixtures, resulting from room reverberations and echoes (e.g. speech signals bouncing off room walls), and may include any of the complications to the mixing process mentioned above.

Mixed signals to be used for source separation can initially be time domain representations of the mixed observations (e.g. in the cocktail party problem mentioned above, they would be mixed audio signals as functions of time). ICA processes have been developed to perform the source separation on time-domain signals from convolutive mixed signals and can give good results; however, the separation of convolutive mixtures of time domain signals can be very computationally intensive, requiring lots of time and processing resources and thus prohibiting its effective utilization in many common real world ICA applications.

A much more computationally efficient algorithm can be implemented by extracting frequency data from the observed time domain signals. In doing this, the convolutive operation in the time domain is replaced by a more computationally efficient multiplication operation in the frequency domain. A Fourier-related transform, such as a short-time Fourier transform (STFT), can be performed on the time-domain data in order to generate frequency representations of the observed mixed signals and load frequency bins, whereby the STFT converts the time domain signals into the time-frequency domain. A STFT can generate a spectrogram for each time segment analyzed, providing information about the intensity of each frequency bin at each time instant in a given time segment.

Traditional approaches to frequency domain ICA involve performing the independent component analysis at each frequency bin (i.e. independence of the same frequency bin between different signals will be maximized) without any constraints derived from prior information. Unfortunately, this approach inherently suffers from a well-known permutation problem, which can cause estimated frequency bin data of the source signals to be grouped in incorrect sources. As such, when resulting time domain signals are reproduced from the frequency domain signals (such as by an inverse STFT), each estimated time domain signal that is produced from the separation process may contain frequency data from incorrect sources.

Various approaches to solving the misalignment of frequency bins in source separation by frequency domain ICA have been proposed. However, to date none of these approaches achieve high enough performance in real world noisy environments to make them an attractive solution for acoustic source separation applications.

Conventional approaches include performing frequency domain ICA at each frequency bin as described above and applying post-processing that involves correcting the alignment of frequency bins by various methods. However, these approaches can suffer from inaccuracies and poor performance in the correcting step. Additionally, because these processes require an additional processing step after the initial ICA separation, processing time and computing resources required to produce the estimated source signals are greatly increased.

Moreover, moving sources can especially complicate source separation because the movements alter the mixing process that mixes the separate source signals before being observed, causing the underlying mixing models used in the separation process to change over time. As such, the source separation process has to account for new mixing models, and utilizing ICA for source separation of moving sources typically requires estimating new mixing models each time any of the sources change position. When using this approach without any further constraints, extremely large amounts of data are needed to produce accurate source separation models from real-time data, rendering the source separation process inefficient and impractical.

To date, known approaches to frequency domain ICA suffer from one or more of the following drawbacks: inability to accurately align frequency bins with the appropriate source, requirement of a post-processing that requires extra time and processing resources, poor performance (i.e. poor signal to noise ratio), inability to efficiently analyze multi-source speech, complex optimization functions that consume processing resources, and a requirement for a limited time frame to be analyzed.

For the foregoing reasons, there is a need for methods and apparatus that can efficiently implement frequency domain independent component analysis to produce estimated source signals from a set of mixed signals without the aforementioned drawbacks. It is within this context that a need for the present invention arises.

BRIEF DESCRIPTION OF THE DRAWINGS

The teachings of the present invention can be readily understood by considering the following detailed description in conjunction with the accompanying drawings, in which.

DETAILED DESCRIPTION

Figure 1A:
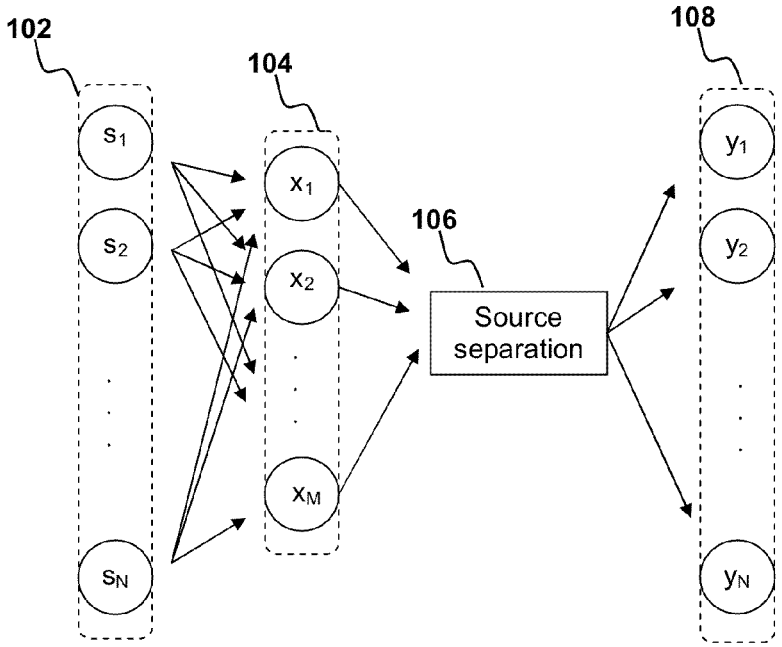
FIG. 1A is a schematic of a source separation process.

The following description will describe embodiments of the present invention primarily with respect to the processing of audio signals detected by a microphone array. More particularly, embodiments of the present invention will be described with respect to the separation of audio source signals, including speech signals and music signals, from mixed audio signals that are detected by a microphone array. However, it is to be understood that ICA has many far reaching applications in a wide variety of technologies, including optical signal processing, neural imaging, stock market prediction, telecommunication systems, facial recognition, and more. Mixed signals can be obtained from a variety of sources by being observed from array of sensors or transducers that are capable of observing the signals of interest into electronic form for processing by a communications device or other signal processing device. Accordingly, the accompanying claims are not to be limited to speech separation applications or microphone arrays except where explicitly recited in the claims.

As noted above, source movement changes the underlying mixing process of the separate source signals, requiring new mixing models to account for the changes to the mixing processes. Typically, when performing source separation by independent component analysis, new de-mixing filters are required with every source movement to account for the corresponding changes in the mixing process. Embodiments of the present invention can provide improved source separation for signals having moving sources by using a model of the source motion in conjunction with source separation by independent component analysis. The model of source motion can be used to improve the efficiency of the separation process and allow future de-mixing operations to be estimated from smaller data sets.

In embodiments of the present invention, information about the movement of sources can be extracted from de-mixing filters to more accurately predict future de-mixing operations to be used in the source separation process. In embodiments of the present invention, source motion can be modeled using the direct to reverberant ratio (DRR) of the sources. DRR measures the ratio of direct energy to reverberant energy that is present in a signal. For example, for a sound source detected in a room by a microphone, DRR will measure the ratio of the signal that travels directly to the microphone to the signal that arrives at the microphone after some reverberation, such as by reflections off room walls. DRR relies on the fact that room impulse response is dependent on the position of a source with respect to a microphone array, where greater DRR generally indicates closer proximity to the microphone array. During movement, the angle and distance of the source to the microphone array changes, and, as such, the change in distance from a source to a microphone can be modeled by a change in the DRR. Using such a model of source motion in conjunction with independent component analysis can allow future demixing operations to be estimated from smaller data sets. In embodiments of the present invention, rather than measuring DRR directly, DRR can be estimated from the coefficients of demixing filters used to separate each source.

Furthermore, in order to address the permutation problem described above, a separation process utilizing ICA can define relationships between frequency bins according to multivariate probability density functions. In this manner, the permutation problem can be substantially avoided by accounting for the relationship between frequency bins in the source separation process and thereby preventing misalignment of the frequency bins as described above.

The parameters for each multivariate PDF that appropriately estimates the relationship between frequency bins can depend not only on the source signal to which it corresponds, but also the time frame to be analyzed (i.e. the parameters of a PDF for a given source signal will depend on the time frame of that signal that is analyzed). As such, the parameters of a multivariate PDF that appropriately models the relationship between frequency bins can be considered to be both time dependent and source dependent. However, it is noted that the general form of the multivariate PDF can be the same for the same types of sources, regardless of which source or time segment that corresponds to the multivariate PDF. For example, all sources over all time segments can have multivariate PDFs with super-Gaussian form corresponding to speech signals, but the parameters for each source and time segment can be different.

Embodiments of the present invention can account for the different statistical properties of different sources as well as the same source over different time segments by using weighted mixtures of component multivariate probability density functions having different parameters in the ICA calculation. The parameters of these mixtures of multivariate probability density functions, or mixed multivariate PDFs, can be weighted for different source signals, different time segments, or some combination thereof. In other words, the parameters of the component probability density functions in the mixed multivariate PDFs can correspond to the frequency components of different sources and/or different time segments to be analyzed. Approaches to frequency domain ICA that utilize probability density functions to model the relationship between frequency bins fail to account for these different parameters by modeling a single multivariate PDF in the ICA calculation. Accordingly, embodiments of the present invention that utilize mixed multivariate PDFs are able to analyze a wider time frame with better performance than embodiments that utilize singular multivariate PDFs, and are able account for multiple speakers in the same location at the same time (i.e. multi-source speech). Therefore, it is noted that it is preferred, but not required, to use mixed multivariate PDFs as opposed to singular multivariate PDFs for ICA operations in embodiments of the present invention.

In the description that follows, models corresponding to ICA processes utilizing single multivariate PDFs and mixed multivariate PDFs in the ICA calculation will be first be explained. Models that perform independent component analysis with a motion constraint that models source motion with the DRR of demixing filters will then be described.

Source Separation Problem Set Up

Referring to FIG. 1A, a basic schematic of a source separation process having N separate signal sources 102 is depicted. Signals from sources 102 can be represented by the column vector $s=[s_1, s_2, \ldots, s_N]^T$. It is noted that the superscript T simply indicates that the column vector s is simply the transpose of the row vector $[s_1, s_2, \ldots, s_N]$. Note that each source signal can be a function modeled as a continuously random variable (e.g. a speech signal as a function of time), but for now the function variables are omitted for simplicity. The sources 102 are observed by M separate sensors 104 (i.e. a multi-channel sensor having M channels), producing M different mixed signals which can be represented by the vector $x=[x_1, x_2, \ldots, x_M]^T$. Source separation 106 separates the mixed signals $x=[x_1, x_2, \ldots, x_M]^T$ received from the sensors 104 to produce estimated source signals 108, which can be represented by the vector $y=[y_1, y_2, \ldots, y_N]^T$ and which correspond to the source signals from signal sources 102. Source separation as shown generally in FIG. 1A can produce the estimated source signals $y=[y_1, y_2, \ldots, y_N]^T$ that correspond to the original sources 102 without information of the mixing process that produces the mixed signals observed by the sensors $x=[x_1, x_2, \ldots, x_M]^T$.

Figure 1B:
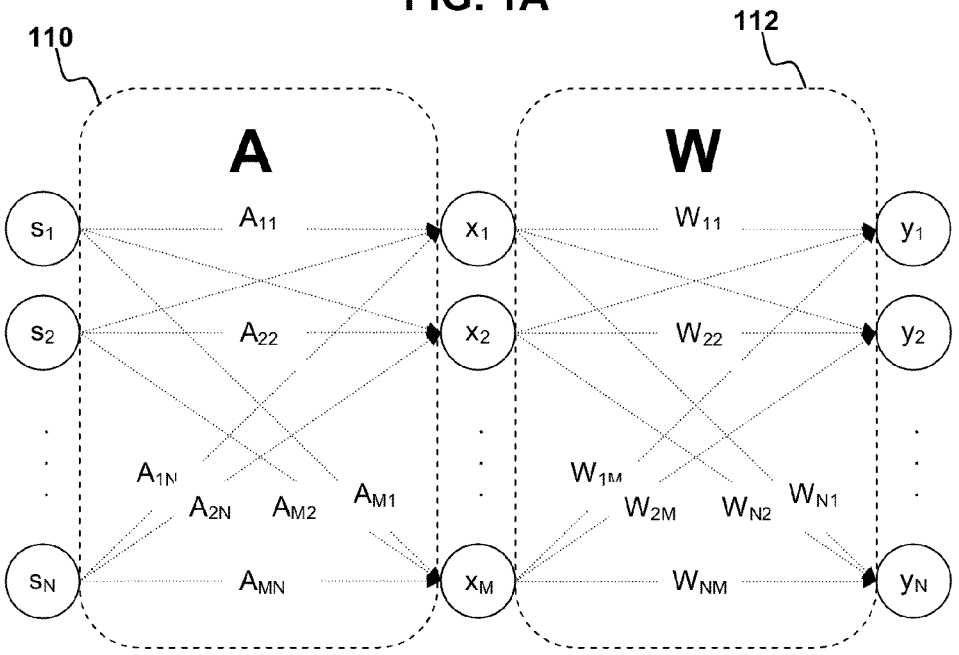
FIG. 1B is a schematic of a mixing and de-mixing model of a source separation process.

Referring to FIG. 1B, a basic schematic of a general ICA operation to perform source separation as shown in FIG. 1A is depicted. In a basic ICA process, the number of sources 102 is equal to the number of sensors 104, such that M=N and the number observed mixed signals is equal to the number of separate source signals to be reproduced. Before being observed by sensors 104, the source signals s emanating from sources 102 are subjected to unknown mixing 110 in the environment before being observed by the sensors 104. This mixing process 110 can be represented as a linear operation by a mixing matrix A as follows:

$$A = \begin{bmatrix} A_{11} & \ldots & A_{1N} \\ \vdots & \ddots & \vdots \\ A_{M1} & \ldots & A_{MN} \end{bmatrix} \tag{1}$$

Multiplying the mixing matrix A by the source signals vector s produces the mixed signals x that are observed by the sensors, such that each mixed signal $x_i$ is a linear combination of the components of the source vector s, and:

$$\begin{bmatrix} x_1 \\ \vdots \\ x_N \end{bmatrix} = \begin{bmatrix} A_{11} & \ldots & A_{1N} \\ \vdots & \ddots & \vdots \\ A_{M1} & \ldots & A_{MN} \end{bmatrix} \begin{bmatrix} s_1 \\ \vdots \\ s_N \end{bmatrix} \tag{2}$$

The goal of ICA is to determine a de-mixing matrix W 112 that is the inverse of the mixing process, such that $W=A^{-1}$. The de-mixing matrix 112 can be applied to the mixed signals $x=[x_1, x_2, \ldots, x_M]^T$ to produce the estimated sources $y=[y_1, y_2, \ldots, y_N]^T$ up to the permuted and scaled output, such that, $$y=Wx=WAs\approx PDs \tag{3}$$

where P and D represent the permutation matrix and the scaling matrix having only diagonal components, respectively.

Flowchart Description

Figure 2:
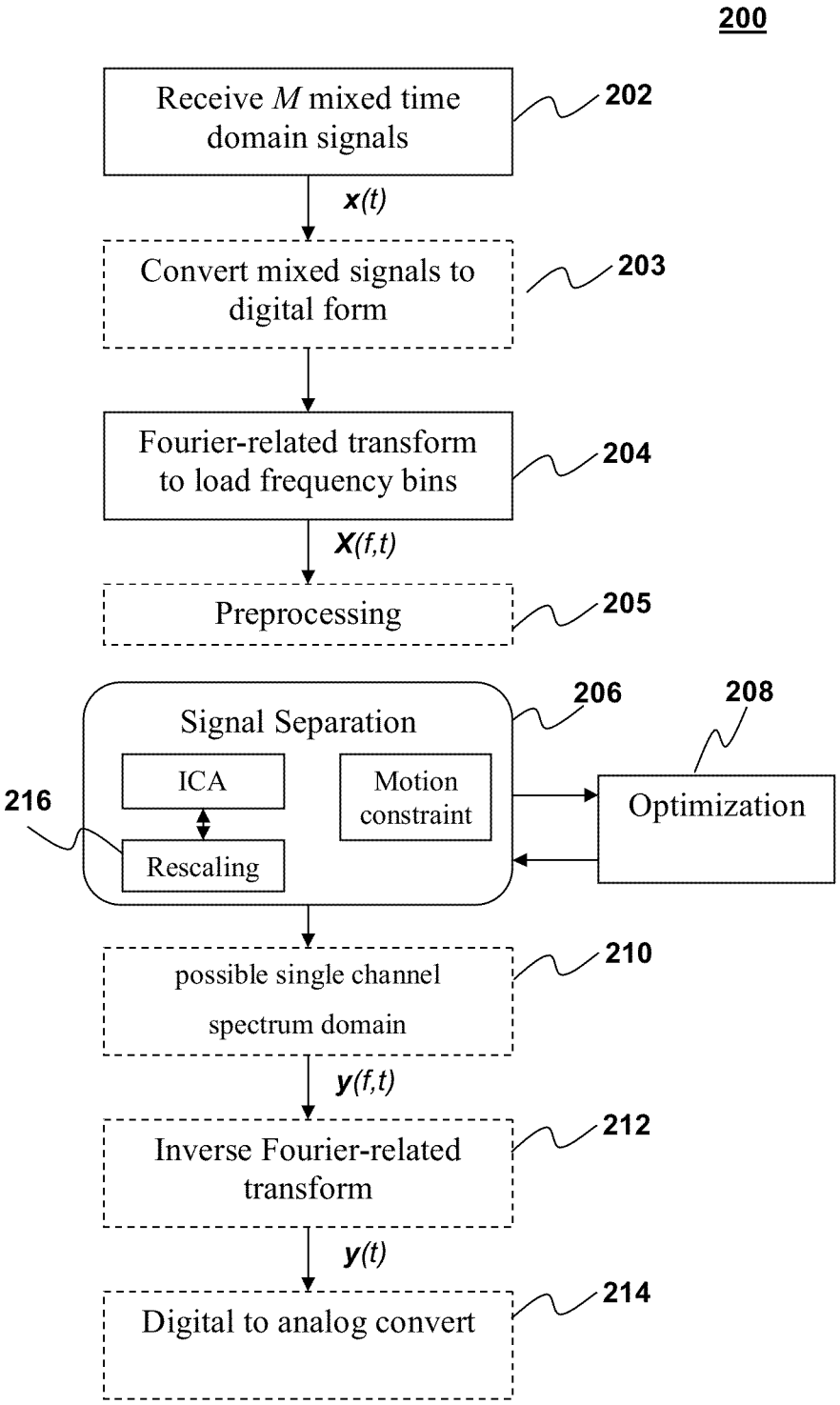
FIG. 2 is a flow diagram of an implementation of source separation utilizing ICA according to an embodiment of the present invention.

Referring now to FIG. 2, a flowchart of a method of signal processing 200 according to embodiments of the present invention is depicted. Signal processing 200 can include receiving M mixed signals 202. Receiving mixed signals 202 can be accomplished by observing signals of interest with an array of M sensors or transducers, such as a microphone array having M microphones that convert observed audio signals into electronic form for processing by a signal processing device. The signal processing device can perform embodiments of the methods described herein and, by way of example, can be an electronic communications device such as a computer, handheld electronic device, videogame console, or electronic processing device. The microphone array can produce mixed signals $x_1(t), \ldots, x_M(t)$ that can be represented by the time domain mixed signal vector x(t). Each component of the mixed signal vector $x_m(t)$ can include a convolutive mixture of audio source signals to be separated, with the convolutive mixing process cause by echoes, reverberation, time delays, etc.

If signal processing 200 is to be performed digitally, signal processing 200 can include converting the mixed signals x(t) to digital form with an analog to digital converter (ADC). The analog to digital conversion 203 will utilize a sampling rate sufficiently high to enable processing of the highest frequency component of interest in the underlying source signal. Analog to digital conversion 203 can involve defining a sampling window that defines the length of time segments for signals to be input into the ICA separation process. By way of example, a rolling sampling window can be used to generate a series of time segments to be converted into the time-frequency domain. The sampling window can be chosen according to various application specific requirements, as well as available resources, processing power, etc.

In order to perform frequency domain independent component analysis according to embodiments of the present invention, a Fourier-related transform 204, preferably STFT, can be performed on the time domain signals to convert them to time-frequency representations for processing by signal processing 200. STFT will load frequency bins 204 for each time segment and mixed signal on which frequency domain ICA will be performed. Loaded frequency bins can correspond to spectrogram representations of each time-frequency domain mixed signal for each time segment.

Although the STFT is referred to herein as an example of a Fourier-related transform, the term "Fourier-related transform" is not so limited. In general, the term "Fourier-related transform" refers to a linear transform of functions related to Fourier analysis. Such transformations map a function to a set of coefficients of basis functions, which are typically sinusoidal and are therefore strongly localized in the frequency spectrum. Examples of Fourier-related transforms applied to continuous arguments include the Laplace transform, the two-sided Laplace transform, the Mellin transform, Fourier transforms including Fourier series and sine and cosine transforms, the short-time Fourier transform (STFT), the fractional Fourier transform, the Hartley transform, the Chirplet transform and the Hankel transform. Examples of Fourier-related transforms applied to discrete arguments include the discrete Fourier transform (DFT), the discrete time Fourier transform (DTFT), the discrete sine transform (DST), the discrete cosine transform (DCT), regressive discrete Fourier series, discrete Chebyshev transforms, the generalized discrete Fourier transform (GDFT), the Z-transform, the modified discrete cosine transform, the discrete Hartley transform, the discretized STFT, and the Hadamard transform (or Walsh function). The transformation of time domain signal to spectrum domain representation can also been done by means of wavelet analysis or functional analysis that is applied to single dimension time domain speech signal. Such transformations are referred to herein as Fourier-related transforms for the sake of convenience.

In order to simplify the mathematical operations to be performed in frequency domain ICA, in embodiments of the present invention, signal processing 200 can include preprocessing 205 of the time frequency domain signal X(f, t), which can include well known preprocessing operations such as centering, whitening, etc. Preprocessing 205 can include de-correlating the mixed signals by principal component analysis (PCA) prior to performing the source separation 206, which can be used to improve the convergence speed and stability.

Signal separation 206 by frequency domain ICA in conjunction with a motion constraint can be performed iteratively in conjunction with optimization 208. Source separation 206 involves setting up a de-mixing matrix operation W that produces maximally independent estimated source signals Y of original source signals S when the de-mixing matrix is applied to mixed signals X corresponding to those received by 202. Source separation 206 utilizes the direct to reverberant ratio of de-mixing filters to model the distance change of sources and estimate source movement.

Source separation 206 incorporates optimization process 208 to iteratively update the de-mixing matrix involved in source separation 206 until the de-mixing matrix converges to a solution that produces maximally independent estimates of source signals. Source separation 206 in conjunction with optimization 208 can involve minimizing a cost function that includes both an ICA operation that utilizes a multivariate probability density function to model the relationship between frequency bins, and a moving constraint that models the distance change between source and sensor from the DRR of de-mixing filters to estimate source movement. Optimization 208 incorporates an optimization algorithm or learning rule that defines the iterative process until the de-mixing matrix converges to an acceptable solution. By way of example, signal separation 206 in conjunction with optimization 208 can use an expectation maximization algorithm (EM algorithm) to estimate the parameters of the component probability density functions in a mixed multivariate PDF. For purposes of developing an algorithm, one can define the cost function using Maximum a Priori (MAP) estimation, Maximum Likelihood (ML) estimation and the like. The solution may then be found using an optimization method like EM, the Gradient method and the like. By way of example, and not by way of limitation one may define the cost function of independence using ML, and optimize it using EM.

Once estimates of source signals are produced by separation process (e.g. after the de-mixing matrix converges), rescaling 216 and possible additional single channel spectrum domain speech enhancement (post processing) 210 can be performed to produce accurate time-frequency representations of estimated source signals required due to simplifying pre-processing step 205.

In order to produce estimated sources signals y(t) in the time domain that directly correspond to the original time domain source signals s(t), signal processing 200 can further include performing an inverse Fourier transform 212 (e.g. inverse STFT) on the time-frequency domain estimated source signals Y(f, t) to produce time domain estimated source signals y(t). Estimated time domain source signals can be reproduced or utilized in various applications after digital to analog conversion 214. By way of example, estimated time domain source signals can be reproduced by speakers, headphones, etc. after digital to analog conversion, or can be stored digitally in a non-transitory computer readable medium for other uses.

Models

Signal processing 200 utilizing source separation 206 and optimization 208 by frequency domain ICA as described above can involve appropriate models for the arithmetic operations to be performed by a signal processing device according to embodiments of the present invention. In the following description, first models will be described that utilize multivariate PDFs in frequency domain ICA operations, wherein the multivariate PDFs are not mixed multivariate PDFs (referred to herein as "single multivariate PDF" or "singular multivariate PDF"). Models will then be described that utilize mixed multivariate PDFs that are mixtures of component multivariate PDFs. New models will then be described that perform ICA in conjunction with a motion constraint according to embodiments of the present invention, utilizing the multivariate PDFs described herein. While the models described herein are provided for complete and clear disclosure of embodiments of the present invention, it is noted that persons having ordinary skill in the art can conceive of various alterations of the following models without departing from the scope of the present invention.

Model Using Multivariate PDFs

A model for performing source separation 206 and optimization 208 using frequency domain ICA as shown in FIG. 2 will first be described according to approaches that utilize singular multivariate PDFs.

In order to perform frequency domain ICA, frequency domain data must be extracted from the time domain mixed signals, and this can be accomplished by performing a Fourier-related transform on the mixed signal data. For example, a short-time Fourier transform (STFT) can convert the time domain signals x(t) into time-frequency domain signals, such that, $$X_m(f,t)=\mathrm{STFT}(x_m(t)) \tag{4}$$

and for F number of frequency bins, the spectrum of the $m^{th}$ microphone will be, $$X_m(t)=[X_m(1,t)\ldots X_m(F,t)] \tag{5}$$

For M number of microphones, the mixed signal data can be denoted by the vector X(t), such that, $$X(t)=[X_1(t)\ldots X_M(t)]^T \tag{6}$$

In the expression above, each component of the vector corresponds to the spectrum of the $m^{th}$ microphone over all frequency bins 1 through F. Likewise, for the estimated source signals Y(t), $$Y_m(t)=[Y_m(1,t)\ldots Y_m(F,t)] \tag{8}$$

$$Y(t)=[Y_1(t)\ldots Y_M(t)]^T \tag{8}$$

Accordingly, the goal of ICA can be to set up a matrix operation that produces estimated source signals Y(t) from the mixed signals X(t), where W(t) is the de-mixing matrix. The matrix operation can be expressed as, $$Y(t)=W(t)X(t) \tag{9}$$

Where W(t) can be set up to separate entire spectrograms, such that each element $W_{ij}(t)$ of the matrix W(t) is developed for all frequency bins as follows, $$W_{ij}(t)=\begin{bmatrix} W_{ij}(1,t) & \ldots & 0 \\ \vdots & \ddots & \vdots \\ 0 & \ldots & W_{ij}(F,t) \end{bmatrix} \tag{10}$$

$$W(t)\triangleq\begin{bmatrix} W_{11}(t) & \ldots & W_{1M}(t) \\ \vdots & \ddots & \vdots \\ W_{M1}(t) & \ldots & W_{MM}(t) \end{bmatrix} \tag{11}$$

For now, it is assumed that there are the same number of sources as there are microphones (i.e. number of sources=M). Embodiments of the present invention can utilize ICA models for underdetermined cases, where the number of sources is greater than the number of microphones, but for now explanation is limited to the case where the number of sources is equal to the number of microphones for clarity and simplicity of explanation.

The de-mixing matrix W(t) can be solved by a looped process that involves providing an initial estimate for de-mixing matrix W(t) and iteratively updating the de-mixing matrix until it converges to a solution that provides maximally independent estimated source signals Y. The iterative optimization process involves an optimization algorithm or learning rule that defines the iteration to be performed until convergence (i.e. until the de-mixing matrix converges to a solution that produces maximally independent estimated source signals).

Optimization can involve the cost function for the independence defined by using mutual information and non-gaussianity as follows, a) Mutual information (MI):

$$J_{ICA}(W)\triangleq \mathrm{MI}(Y)=\mathrm{KLD}(P_{Y(f,t)}(Y(f,t))\|\Pi P_{Y_i(f,t)}(Y_i(f,t))) \tag{12}$$

where KLD is denoted by Kullback-Leibler Divergence that is the distance measurement between two probability density functions, and is defined by $$P_{Y_m}(Y_m(t))=h\cdot\phi(\|Y_m(t)\|_2) \tag{15}$$

$$\|Y_m(t)\|_2\triangleq\left(\sum_f|Y_m(f,t)|^2\right)^{\frac{1}{2}} \tag{16}$$

b) Non-gaussianity (NG) using Negentropy:

$$J_{ICA}(W)\triangleq \mathrm{NG}(Y)=\mathrm{KLD}(P_{Y(f,t)}(Y(f,t))\|P_{Y_{gauss}}(Y_{gauss})) \tag{14}$$

Using a spherical distribution as one kind of PDF, the PDF $P_{Y_m}(Y_m(t))$ of the spectrum of $m^{th}$ source can be, $$KLD(P_x(x)\,|\,P_y(y))=\int P_x(x)\log\left(\frac{P_x(x)}{P_y(y)}\right) \tag{13}$$

Where $\psi(x)=\exp\{-\Omega|x|\}$, Ω is a proper constant and h is the normalization factor in the above expression. The final multivariate PDF for the $m^{th}$ source is thus, $$\begin{aligned} P_{Y_m}(Y_m(t)) &= h\cdot\phi(\|Y_m(t)\|_2) \\ &= h\exp\{-\Omega\|Y_m(t)\|_2\} \\ &= h\exp\left\{-\Omega\left(\sum_f|Y_m(f,t)|^2\right)^{\frac{1}{2}}\right\} \end{aligned} \tag{17}$$

The model described above addresses the solution of permutation problem with the cost function that utilizes the multivariate PDF to model the relationship between frequency bins, the permutation problem is described in Equation (3) as permutation matrix. Solving for the de-mixing matrix involves the cost functions above and multivariate PDF, which produce maximally independent estimated source signals without permutation problem.

Model Using Mixed Multivariate PDFs

Having modeled known approaches that utilize singular multivariate PDFs in frequency domain ICA, a model using mixed multivariate PDFs will be described.

A speech separation system can utilize independent component analysis involving mixed multivariate probability density functions that are mixtures of L component multivariate probability density functions having different parameters. It is noted that the separate source signals can be expected to have PDFs with the same general form (e.g. separate speech signals can be expected to have PDFs of super-Gaussian form), but the parameters from the different source signals can be expected to be different. Additionally, because the signal from a particular source will change over time, the parameters of the PDF for a signal from the same source can be expected to have different parameters at different time segments. Accordingly, mixed multivariate PDFs can be utilized that are mixtures of PDFs weighted for different sources and/or different time segments. Accordingly, embodiments of the present invention can utilize a mixed multivariate PDF that accounts for the different statistical properties of different source signals as well as the change of statistical properties of a signal over time.

As such, for a mixture of L different component multivariate PDFs, L can generally be understood to be the product of the number of time segments and the number of sources for which the mixed PDF is weighted (e.g. L=number of sources×number of time segments).

Embodiments of the present invention can utilize pre-trained eigenvectors to estimate of the de-mixing matrix. Where V(t) represents pre-trained eigenvectors and E(t) is the eigenvalues, de-mixing can be represented by, $$Y(t)=V(t)E(t)=W(t)X(t) \tag{18}$$

V(t) can be pre-trained eigenvectors of clean speech, music, and noises (i.e. V(t) can be pre-trained for the types of original sources to be separated). Optimization can be performed to find both E(t) and W(t). When it is chosen that V(t)≡I then estimated sources equal the eigenvalues such that Y(t)=E(t).

Optimization according to embodiments of the present invention can involve utilizing an expectation maximization algorithm (EM algorithm) to estimate the parameters of the mixed multivariate PDF for the ICA calculation.

According to embodiments of the present invention, the probability density function $P_{Y_{m,l}}(Y_{m,l}(t))$ is assumed to be a mixed multivariate PDF that is a mixture of multivariate component PDFs. Where the mixing system that uses singular multivariate PDFs is represented by X(f,t)=A(f)S(f,t), the mixing system for mixed multivariate PDFs becomes, $$X(f,t)=\Sigma_{l=0}^{L}A(f,l)S(f,t-l) \tag{19}$$

Likewise, where the de-mixing system for singular multivariate PDFs is represented by Y(f,t)=W(f)X(f,t) the de-mixing system for mixed multivariate PDFs becomes, $$Y(f,t)=\Sigma_{l=0}^{L}W(f,l)X(f,t-l)=\Sigma_{l+2}^{L}Y_{m,l}(f,t) \tag{20}$$

Where A(f, l) is a time dependent mixing condition and can also represent a long reverberant mixing condition. Where spherical distribution is chosen for the PDF, the mixed multivariate PDF becomes, $$P_{Y_m}(Y_{m,l}(t))\triangleq\Sigma_l^L b_l(t)P_{Y_{m,l}}(Y_m(t)),t\propto[t1,t2] \tag{21}$$

$$P_{Y_m}(Y_m(t))=\Sigma_l b_l(t)h_l f_l(\|Y_m(t)\|_2),t\propto[t1,t2] \tag{22}$$

Where multivariate generalized Gaussian is chosen for the PDF, the mixed multivariate PDF becomes, $$P_{Y_{m,l}}(Y_{m,l}(t))\triangleq\Sigma_l^L b_l(t)h_l\Sigma_c\tilde{n}(c_l(m,t))\Pi_f N_c(Y_m(f,t)|0,v_{Y_m(f,t)}^{f}),t\propto[t1,t2] \tag{23}$$

Where ρ(c) is the weight between different c-th component multivariate generalized Gaussian and $b_l(t)$ is the weight between different time segments. $N_c(Y_m(f,t)|0, v_{Y_m(f,t)}^{f})$ can be pre-trained with offline data, and further trained with run-time data.

Note that a model for underdetermined cases (i.e. where the number of sources is greater than the number of microphones) can be derived from expressions (22) through (26) above and are within the scope of the present invention.

The ICA model used in embodiments of the present invention can utilize the cepstrum of each mixed signal, where $X_m(f, t)$ can be the cepstrum of $x_m(t)$ plus the log value (or normal value) of pitch, as follows, $$X_m(f,t)=\mathrm{STFT}(\log(\|x_m(t)\|^2)),f=1,2,\ldots,F-1 \tag{24}$$

$$X_m(F,t)\triangleq\log(f_0(t)) \tag{25}$$

$$X_m(t)=[X_m(1,t)\ldots X_{F-1}(F-1,t)X_F(F,t)] \tag{26}$$

It is noted that a cepstrum of a time domain speech signal may be defined as the Fourier transform of the log (with unwrapped phase) of the Fourier transform of the time domain signal. The cepstrum of a time domain signal S(t) may be represented mathematically as (log(FT(S(t)))+j2∂q), where q is the integer required to properly unwrap the angle or imaginary part of the complex log function. Algorithmically, the cepstrum may be generated by performing a Fourier transform on a signal, taking a logarithm of the resulting transform, unwrapping the phase of the transform, and taking a Fourier transform of the transform. This sequence of operations may be expressed as: signal→FT→log→phase unwrapping→FT→cepstrum.

In order to produce estimated source signals in the time domain, after finding the solution for Y(t), pitch+cepstrum simply needs to be converted to a spectrum, and from a spectrum to the time domain in order to produce the estimated source signals in the time domain. The rest of the optimization remains the same as discussed above.

Different forms of PDFs can be chosen depending on various application specific requirements for the models used in source separation according to embodiments of the present invention. By way of example, the form of PDF chosen can be spherical. More specifically, the form can be super-Gaussian, Laplacian, or Gaussian, depending on various application specific requirements. It is noted that, where a mixed multivariate PDF is chosen, each mixed multivariate PDF is a mixture of component PDFs, and each component PDF in the mixture can have the same form but different parameters.

Figure 3A:
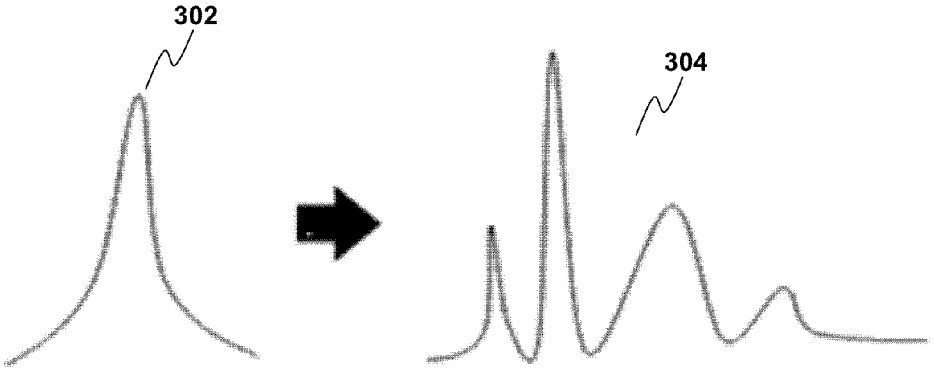
FIG. 3A is a drawing demonstrating the difference between a singular probability density function and a mixed probability density function.
Figure 3B:
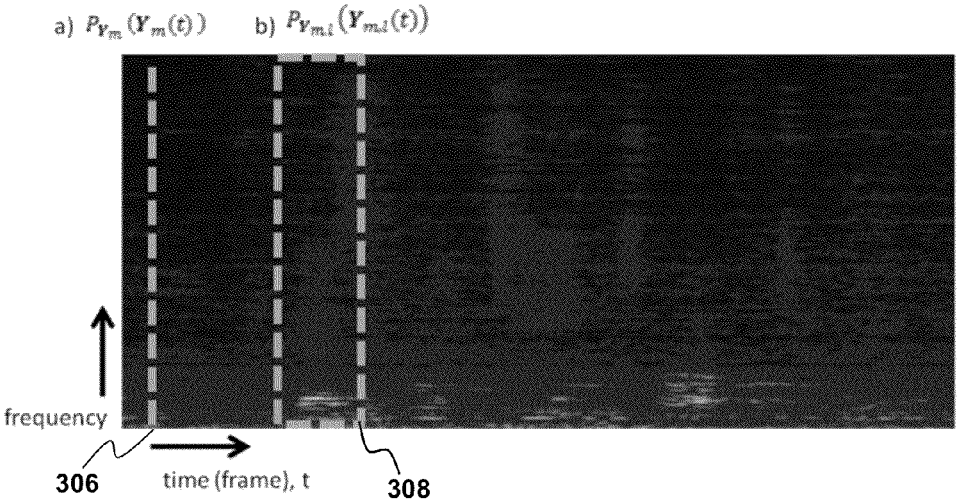
FIG. 3B is a spectrogram demonstrating the difference between a singular probability density function and a mixed probability density function.

A mixed multivariate PDF may result in a probability density function having a plurality of modes corresponding to each component PDF as shown in FIGS. 3A-3B. In the singular PDF 302 in FIG. 3A, the probability density as a function of a given variable is uni-modal, i.e., a graph of the PDF 302 with respect to a given variable has only one peak. In the mixed PDF 304 the probability density as a function of a given variable is multi-modal, i.e., the graph of the mixed PDF 304 with respect to a given variable has more than one peak. It is noted that FIG. 3 is provided as a demonstration of the difference between a singular PDF 302 and a mixed PDF 304. Note, however, that the PDFs depicted in FIG. 3 are univariate PDFs and are merely provided to demonstrate the difference between a singular PDF and a mixed PDF. In mixed multivariate PDFs there would be more than one variable and the PDF would be multi-modal with respect to one or more of those variables. In other words, there would be more than one peak in a graph of the PDF with respect to at least one of the variables.

Referring to FIG. 3B, a spectrogram is depicted to demonstrating the difference between a singular multivariate PDF and a mixed multivariate PDF, and how a mixed multivariate PDF can be weighted for different time segments. Singular multivariate PDF corresponding to time segment 306 as shown by dotted line can correspond to $P_{Y_m}(Y_m(t))$ as described above. By contrast, mixed multivariate PDF corresponding to time frame 308 can cover a time frame that spans multiple different time segments, as shown by the dotted rectangle in FIG. 3B. A mixed multivariate PDF can correspond to $P_{Y_{m,l}}(Y_{m,l}(t))$ as described above.

Model with Motion Constraint

Figure 4A:
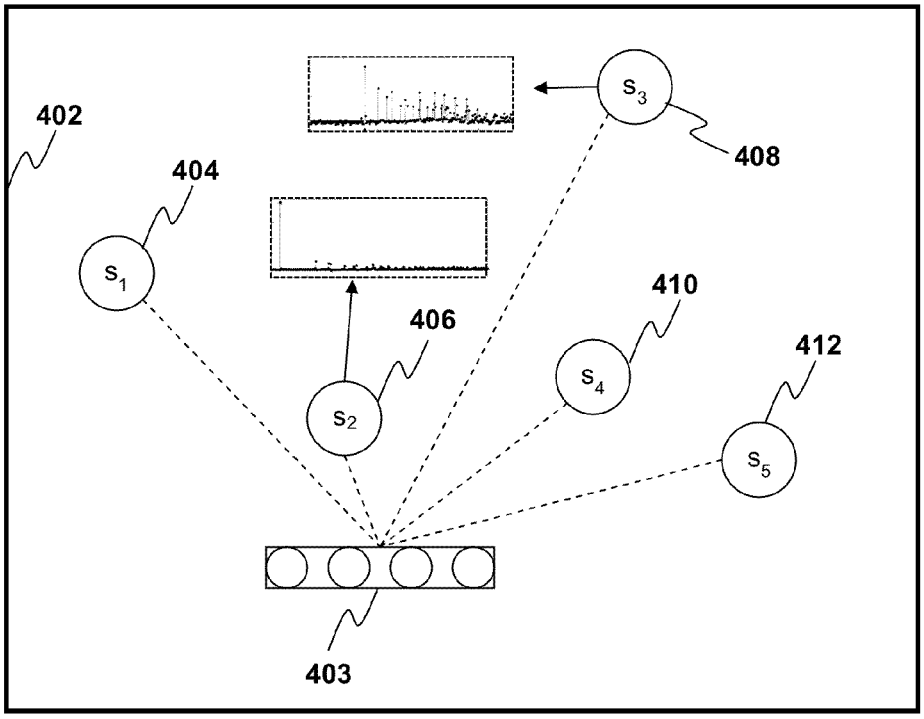
FIG. 4A is a schematic depicting the direct to reverberant ratio of sources signals in different locations.
Figure 4B:
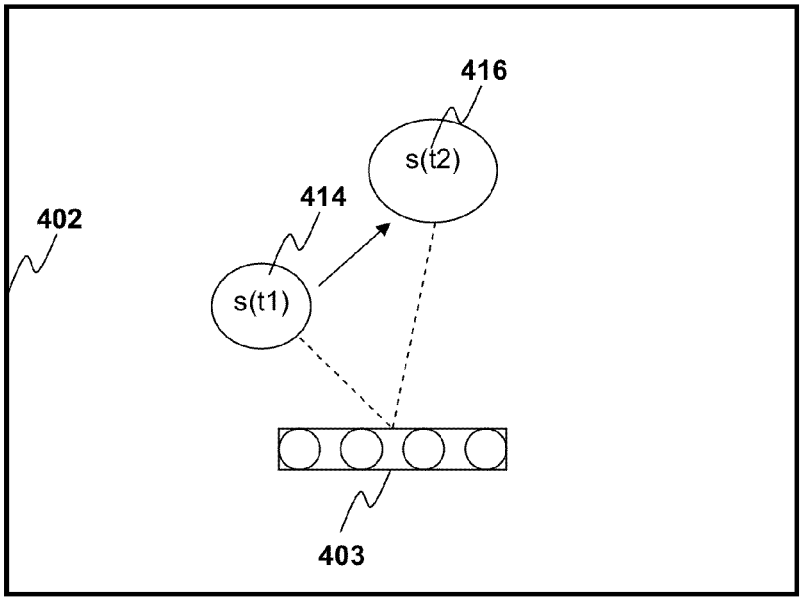
FIG. 4B is a schematic depicting how direct to reverberant ratio can be used as a model of moving sources.

Referring to FIG. 4, a diagram is depicted demonstrating how DRR is affected by the proximity of a source to a sensor that detects its signal. In FIG. 4A, sources $s_n$ are depicted in room 402, where the room's walls deflect the sound signals propagating from the sources and result in room reverberations. Due to these reverberations of the sound signals in room 402, the audio signals detected by microphone array 403 will include both direct energy components, where signals travel a direct path to the microphones, and reverberant energy components, which are signals detected after some reverberations, i.e. after some reflection at room walls 402. In FIG. 4A, a graph is depicted for spectra of both the closest source 406 to microphone array 403, and the farther source 408, and it can be seen from the illustrated graphs that the DRR is much greater for the closest source 406. FIG. 4B demonstrates how this same principle can be used to model source movement. In FIG. 4B, the position of source is indicated at time $t_1$ by 414, and after some movement at time $t_2$ its position is indicated by 416 which is farther away from the microphone array 403 than at time $t_1$. As a result, the DRR of source s can be expected to greater at time $t_1$ than at time $t_2$, and the source's motion can be modeled accordingly.

To model the problem with a moving constraint the demixing filters at both t1 and t2 are obtained. After obtaining the demixing filters and calculating the DRR and variation in DRR, one can determine whether the source is moving and the degree of the movement. Because the movements alter the mixing process that mixes the separate source signals before being observed, performance can be improved by detecting the movement and predicting the demixing filters given a relatively small amount data.

Having described ICA techniques that use multivariate probability density functions to preserve the alignment of frequency bins in the estimated source signals, models that utilize source model of source motion as described above by incorporating a motion constraint with the underlying ICA will now be described according to embodiments of the present invention.

During an analysis time segment from $t_1$ to $t_2$, a target source can move from point a to point b. Accordingly, the movement of the source can be modeled by the direction and the change in distance between the source and the sensor at times $t_1$ and $t_2$. As noted above, the distance can be modeled by the DRR. The ratio of direct to reverberant components' energy in the frequency domain can be modeled by the variance of the magnitude response of demixing filters. The operation DRR (.) can be any function for measuring the variance of magnitude response. By way of example, and not by way of limitation, one can use the logarithm of the variance function as the operation DRR(.), e.g., as shown in equation (28) below.

$$DRR(W_i(f,t)) = \log(\mathrm{var}(|W_i(f,t)|)) = \log\left(\frac{1}{F}\sum_{f=1}^{F}|W_i(f,t)|^2\right) \tag{27}$$

Where |.| is the absolute value operation for a complex variable, $W_i(f,t)$ is the sum of demixing filters for source i from over all microphones j, such that, $$W_i(f,t) \triangleq \Sigma_{j=1}^{M} W_{ij}(f,t)\exp(-j2\check{\partial}\hat{\partial}_{ji}) \tag{28}$$

Where and $\tau_{ji}$ is the phase of the $i^{th}$ source at the $j^{th}$ sensor in the array.

The phase $\hat{o}_{ji}$ at each sensor j can be described by the following equation, $$\hat{o}_{ji} = \frac{(dist_{ji} - dist_{1i})}{c}Fs \tag{28a}$$

Where $dist_{ji}$ is the distance between the $i^{th}$ source and the $j^{th}$ sensor, $dist_{1i}$ is the distance between the $i^{th}$ source to the $1^{st}$ sensor, c is the signal speed from source to sensor (e.g., the speed of sound in the case of microphones) and Fs is the sampling frequency.

Accordingly, where the demixing process is represented as the matrix operation applying the demixing filters to the mixed signals as follows, A new cost function that combines the output of demixing process and predicted output for source movement may be defined as follows.

$$J_{new}(W)=J_{ICA}(Y(t))+\ddot{e}J_{ICA}(\tilde{Y}(t)) \tag{29}$$

where ë is a constant, $\tilde{Y}(t)$ is the predicted output that is obtained by predicted demixing filter $\tilde{W}(f,t)$ as follows, $$\tilde{Y}(f,t)=\tilde{W}(f,t)X(f,t) \tag{30}$$

It's noticeable that $\tilde{Y}(t)$ and $\tilde{W}(f,t)$ contain the information of current and previous frames in conjunction of moving constraint. As a result, equation (29) gives a solution for source movement when the source is moving. Furthermore equation (29) becomes exactly same as $J_{ICA}(Y(t))$ because $\tilde{W}_{ij}(f,t)$ becomes $W_{ij}(f,t-1)$ when the source is fixed.

By separating demixing filters at t−1 frame into magnitude and phase parts, the predicted demixing filters may be written as follows, $$\tilde{W}_{ij}(f,t)=|W_{ij}(f,t-1)|\epsilon_i(f,t)e^{j\arg(W_{ij}(f,t-1)\hat{o}_{ij}(f,t))}= W(f,t-1)\epsilon_i(f,t)e^{j\arg(\hat{o}_{ij}(f,t))} \tag{31}$$

where $\tilde{W}_{ij}(f,t)$ are the new demixing filters, which are calculated by direction and distance information. The quantity $\epsilon_i(f,t)$ represents the degree of reverberant component with a positive real value, and is calculated using the DRR of demixing filters from a current frame (at time t) and a previous frame (at time t−1), and $\hat{o}_{ij}(f)$ can be calculated by direction estimation method that is described in commonly-assigned co-pending application Ser. No. 13/464,828, which was incorporated herein by reference above.

$$\epsilon_i(f,t)=g(|\mathrm{DRR}(W_i(f,t))-\mathrm{DRR}(W_i(f,t-1))|) \tag{32}$$

where g( ) can be any function characterized by a limited magnitude, and |.| is the absolute value operation. By way of example, and not by way of limitation, one can use the following equation as the limitation of magnitude, e.g., as shown in equation (33) below, $$g(x) = \frac{ax}{1+|x|} \tag{33}$$

where a is a positive constant.

We update the demixing filter using gradient method as follows, $$W_{ij}(f,t) = W_{ij}(f,t-1) + \varsigma\left(\frac{\partial J_{ICA}(Y(t))}{\partial W_{ij}(f,t)} + \ddot{e}\frac{\partial J_{ICA}(\tilde{Y}(t-1))}{\partial W_{ij}(f,t)}\right) \tag{34}$$

To calculate the gradient vector, we use the definition of $J_{ICA}(Y(t))$ that described in equation (12), (14). For example, the mutual information (MI) as defined in equation (12) is used for the independence and non-mixed multivariate PDF for the permutation solution, the gradient vectors as follows $$\frac{\partial MI(Y)}{\partial W_{ij}(f)} = \begin{cases} [1 - E(\phi(Y_i(t))Y_i(f,t))]W_{ij}(f,t-1) & (i=j) \\ [-E(\phi(Y_i(t))Y_i(f,t))]W_{ij}(f,t-1) & (i \neq j) \end{cases} \tag{35}$$

$$\frac{\partial MI(\tilde{Y})}{\partial W_{ij}(f)} = \begin{cases} \left[1 - E\left(\phi(Y_i'(t-1))\left(Y_i'(f,t-1)\epsilon_i(f,t)e^{j\arg(\hat{\sigma}_{ij}(f,t))}\right)\right)\right]W_{ij}(f,t-1) & (i=j) \\ \left[-E\left(\phi(Y_i'(t-1))\left(Y_i^i(f,t-1)\epsilon_i(f,t)e^{j\arg(\hat{\sigma}_{ij}(f,t))}\right)\right)\right]W_{ij}(f,t-1) & (i \neq j) \end{cases} \tag{36}$$

where ç is the learning rate, $$\phi(Y_i(t)) = -\frac{\partial \log P_{Y_i(t)}(Y_i(t))}{\partial Y_i(f,t)},$$

Y'(t−1)=W(f,t−1)X(f,t) and E( ) is the expectation operation.

Accordingly, the above cost function includes a moving constraint that can be combined with the cost function of independence to perform improved source separation by independent component analysis for moving sources. Minimizing or maximizing the cost function above by an optimization process can provide maximally independent source signals, whereby the motion constraint permits future de-mixing filters to predict from a smaller data set.

Rescaling Process (FIG. 2, 216)

The rescaling process indicated at 216 of FIG. 2 adjusts the scaling matrix which is described in equation (3) among the frequency bins of the spectrograms. Furthermore, rescaling process 216 cancels the effect of the pre-processing.

By way of example, and not by way of limitation, the rescaling process indicated at 216 in may be implemented using any of the techniques described in U.S. Pat. No. 7,797,153 (which is incorporated herein by reference) at col. 18, line 31 to col. 19, line 67, which are briefly discussed below.

According to a first technique each of the estimated source signals $Y_k(f,t)$ may be re-scaled by producing a signal having the single Input Multiple Output from the estimated source signals $Y_k(f,t)$ (whose scales are not uniform). This type of re-scaling may be accomplished by operating on the estimated source signals with an inverse of a product of the de-mixing matrix W(f) and a pre-processing matrix Q(f) to produce scaled outputs $X_{yk}(f,t)$ given by:

$$X_{yk}(f,t) = (W(f)Q(f))^{-1}\begin{bmatrix} 0 \\ \vdots \\ Y_k(f,t) \\ \vdots \\ 0 \end{bmatrix} \tag{37}$$

where $X_{yk}(f,t)$ represents a signal at $y^{th}$ output from $k^{th}$ source. Q(f) represents a pre-processing matrix, which may be implanted as part of the pre-processing indicated at 205 of FIG. 2 The pre-processing matrix Q(f) may be configured to make mixed input signals X(f,t) have zero mean and unit variance at each frequency bin.

Q(f) can be any function to give the decorated output. By way of example, and not by way of limitation, one can use the following equation as the decorrelation process, e.g., as shown in equations below We can calculate the pre-processing matrix Q(f) as follows $$R(f)=E(X(f,t)X(f,t)^H) \tag{38}$$

$$R(f)q_n(f)=\lambda_n(f)q_n(f) \tag{39}$$

where $q_n(f)$ is the eigen vector and $\lambda_n(f)$ is the eigen value.

$$Q'(f)=[q_1(f)\ldots q_N(f)] \tag{40}$$

$$Q(f)=\mathrm{diag}(\lambda_1(f)^{-1/2},\ldots,\lambda_N(f)^{-1/2})Q'(f)^H \tag{41}$$

In a second re-scaling technique, based on the minimum distortion principle, the de-mixing matrix W(f) may be recalculated according to:

$$W(f)\leftarrow \mathrm{diag}(W(f)Q(f)^{-1})W(f)Q(f) \tag{42}$$

In equation (42), Q(f) again represents the pre-processing matrix used to pre-process the input signals X(f,t) at 205 of FIG. 2 such that they have zero mean and unit variance at each frequency bin. $Q(f)^{-1}$ represents the inverse of the pre-processing matrix Q(f). The recalculated de-mixing matrix W(f) may then be applied to the original input signals X(f,t) to produce re-scaled estimated source signals $Y_k(f,t)$.

A third technique utilizes independency of an estimated source signal $Y_k(f,t)$ and a residual signal. A re-scaled estimated source signal may be obtained by multiplying the source signal $Y_k(f,t)$ by a suitable scaling coefficient $\acute{a}_k(f)$ for the $k^{th}$ source and $f_{th}$ frequency bin. The residual signal is the difference between the original mixed signal $X_k(f,t)$ and the re-scaled source signal. If $\acute{a}_k(f)$ has the correct value, the factor $Y_k(f,t)$ disappears completely from the residual and the product $\acute{a}_k(f)\cdot Y_k(f,t)$ represents the original observed signal. The scaling coefficient may be obtained by solving the following equation:

$$E[f(X_k(f,t)-\acute{a}_k(f)Y_k(f,t)\overline{g(Y_k(f,t))}]-E[f(X_k(f,t)-\acute{a}_k(f)Y_k(f,t)]E[\overline{g(Y_k(f,t))}]=0 \tag{43}$$

In equation (43), the functions f(.) and g(.) are arbitrary scalar functions. The overlying line represents a conjugate complex operation and E[ ] represents computation of the expectation value of the expression inside the square brackets. As a result, the scaled output is calculated by $Y_k^{new}(f,t)=\acute{a}_k(f)Y_k(f,t)$.

Signal Processing Device Description

In order to perform source separation according to embodiments of the present invention as described above, a signal processing device may be configured to perform the arithmetic operations required to implement embodiments of the present invention. The signal processing device can be any of a wide variety of communications devices. For example, a signal processing device according to embodiments of the present invention can be a computer, personal computer, laptop, handheld electronic device, cell phone, videogame console, etc.

Figure 5:
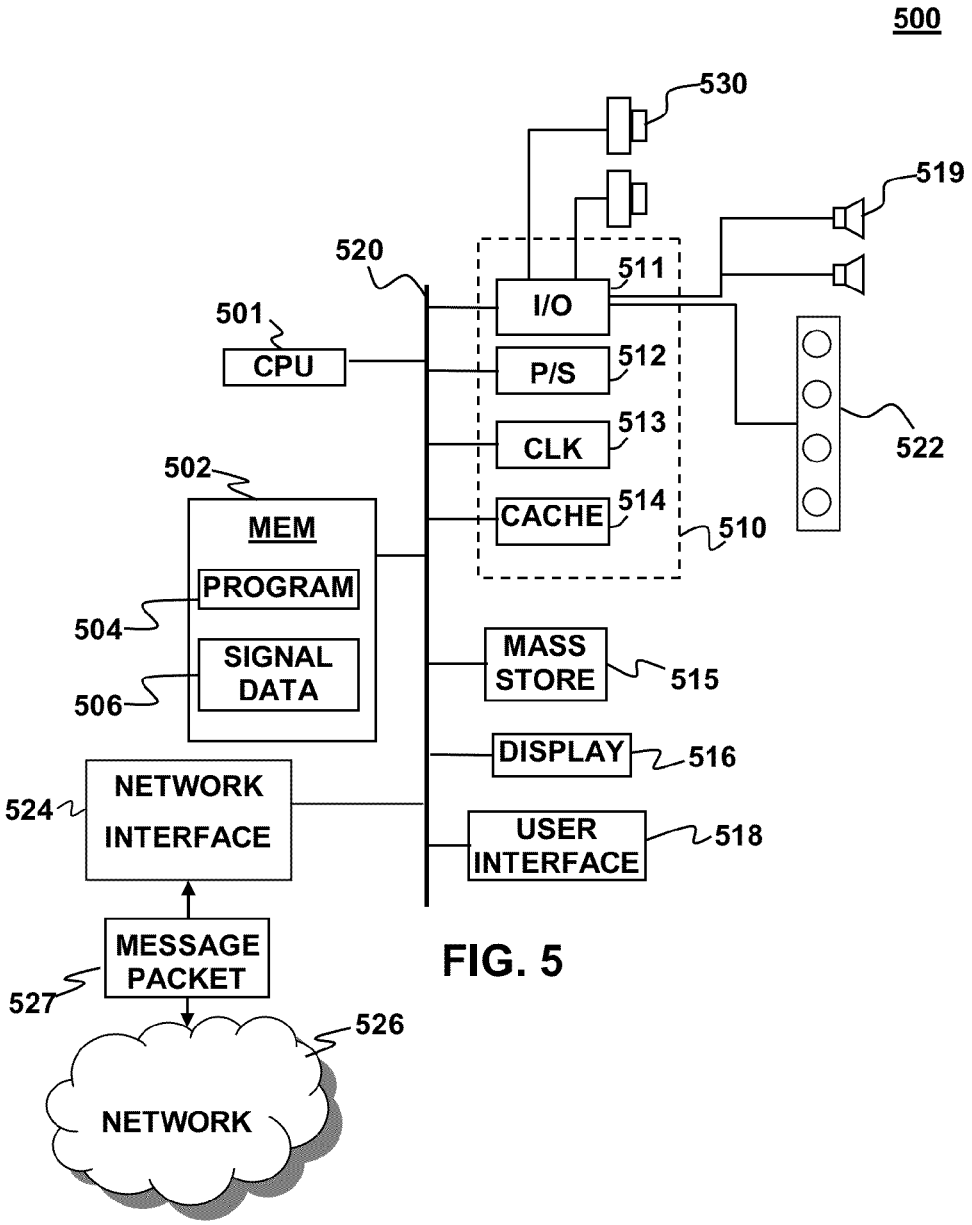
FIG. 5 is a block diagram of a source separation apparatus according to an embodiment of the present invention.

Referring to FIG. 5, an example of a signal processing device 500 capable of performing source separation according to embodiments of the present invention is depicted. The apparatus 500 may include a processor 501 and a memory 502 (e.g., RAM, DRAM, ROM, and the like). In addition, the signal processing apparatus 500 may have multiple processors 501 if parallel processing is to be implemented. Furthermore, signal processing apparatus 500 may utilize a multi-core processor, for example a dual-core processor, quad-core processor, or other multi-core processor. The memory 502 includes data and code configured to perform source separation as described above. Specifically, the memory 502 may include signal data 506 which may include a digital representation of the input signals x (e.g., after analog to digital conversion as shown at 203 in FIG. 2), and code for implementing source separation using mixed multivariate PDFs as described above to estimate source signals contained in the digital representations of mixed signals x.

The apparatus 500 may also include well-known support functions 510, such as input/output (I/O) elements 511, power supplies (P/S) 512, a clock (CLK) 513 and cache 514. The apparatus 500 may include a mass storage device 515 such as a disk drive, CD-ROM drive, tape drive, or the like to store programs and/or data. The apparatus 400 may also include a display unit 516 and user interface unit 518 to facilitate interaction between the apparatus 500 and a user. The display unit 516 may be in the form of a cathode ray tube (CRT) or flat panel screen that displays text, numerals, graphical symbols or images. The user interface 518 may include a keyboard, mouse, joystick, light pen or other device. In addition, the user interface 518 may include a microphone, video camera or other signal transducing device to provide for direct capture of a signal to be analyzed. The processor 501, memory 502 and other components of the system 500 may exchange signals (e.g., code instructions and data) with each other via a system bus 520 as shown in FIG. 5.

A sensor array, e.g., a microphone array 522 may be coupled to the apparatus 500 through the I/O functions 511. The microphone array may include two or more microphones. The microphone array may preferably include at least as many microphones as there are original sources to be separated; however, microphone array may include fewer or more microphones than the number of sources for underdetermined and overdetermined cases as noted above. Each microphone the microphone array 522 may include an acoustic transducer that converts acoustic signals into electrical signals. The apparatus 500 may be configured to convert analog electrical signals from the microphones into the digital signal data 506.

It is further noted that in some implementations, one or more sound sources 519 may be coupled to the apparatus 500, e.g., via the I/O elements or a peripheral, such as a game controller. In addition, one or more image capture devices 530 may be coupled to the apparatus 500, e.g., via the I/O elements 511 or a peripheral such as a game controller.

As used herein, the term I/O generally refers to any program, operation or device that transfers data to or from the system 500 and to or from a peripheral device. Every data transfer may be regarded as an output from one device and an input into another. Peripheral devices include input-only devices, such as keyboards and mouses, output-only devices, such as printers as well as devices such as a writable CD-ROM that can act as both an input and an output device. The term "peripheral device" includes external devices, such as a mouse, keyboard, printer, monitor, microphone, game controller, camera, external Zip drive or scanner as well as internal devices, such as a CD-ROM drive, CD-R drive or internal modem or other peripheral such as a flash memory reader/writer, hard drive.

The apparatus 500 may include a network interface 524 to facilitate communication via an electronic communications network 526. The network interface 524 may be configured to implement wired or wireless communication over local area networks and wide area networks such as the Internet. The apparatus 500 may send and receive data and/or requests for files via one or more message packets 527 over the network 526.

The processor 501 may perform digital signal processing on signal data 506 as described above in response to the data 506 and program code instructions of a program 504 stored and retrieved by the memory 502 and executed by the processor module 501. Code portions of the program 504 may conform to any one of a number of different programming languages such as Assembly, C++, JAVA or a number of other languages. The processor module 501 forms a general-purpose computer that becomes a specific purpose computer when executing programs such as the program code 504. Although the program code 504 is described herein as being implemented in software and executed upon a general purpose computer, those skilled in the art may realize that the method of task management could alternatively be implemented using hardware such as an application specific integrated circuit (ASIC) or other hardware circuitry. As such, embodiments of the invention may be implemented, in whole or in part, in software, hardware or some combination of both.

An embodiment of the present invention may include program code 504 having a set of processor readable instructions that implement source separation methods as described above. The program code 504 may generally include instructions that direct the processor to perform source separation on a plurality of time domain mixed signals, where the mixed signals include mixtures of original source signals to be extracted by the source separation methods described herein. The instructions may direct the signal processing device 500 to perform a Fourier-related transform (e.g. STFT) on a plurality of time domain mixed signals to generate time-frequency domain mixed signals corresponding to the time domain mixed signals and thereby load frequency bins. The instructions may direct the signal processing device to perform independent component analysis as described above on the time-frequency domain mixed signals to generate estimated source signals corresponding to the original source signals. The independent component analysis may utilize singular probability density functions, or mixed multivariate probability density functions that are weighted mixtures of component probability density functions of frequency bins corresponding to different source signals and/or different time segments. The independent component analysis may be performed with a direction constraint based on prior information regarding the direction of a desired source signal with respect to a sensor array. The independent component analysis may take into account a moving constraint by analysis of changes on the direct to reverberant ratio in the signals received by the sensors in the array.

It is noted that the methods of source separation described herein generally apply to estimating multiple source signals from mixed signals that are received by a signal processing device. It may be, however, that in a particular application the only source signal of interest is a single source signal, such as a single speech signal mixed with other source signals that are noises. By way of example, a source signal estimated by audio signal processing embodiments of the present invention may be a speech signal, a music signal, or noise. As such, embodiments of the present invention can utilize ICA as described above in order to estimate at least one source signal from a mixture of a plurality of original source signals.

Although the detailed description herein contains many specific details for the purposes of illustration, anyone of ordinary skill in the art will appreciate that many variations and alterations to the details described herein are within the scope of the invention. Accordingly, the exemplary embodiments of the invention described herein are set forth without any loss of generality to, and without imposing limitations upon, the claimed invention.

While the above is a complete description of the preferred embodiments of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "a", or "an" when used in claims containing an open-ended transitional phrase, such as "comprising," refers to a quantity of one or more of the item following the article, except where expressly stated otherwise. Furthermore, the later use of the word "said" or "the" to refer back to the same claim term does not change this meaning, but simply re-invokes that non-singular meaning. The appended claims are not to be interpreted as including means-plus-function limitations or step-plus-function limitations, unless such a limitation is explicitly recited in a given claim using the phrase "means for" or "step for."

What is claimed is:

1. A method of processing signals with a signal processing device, comprising:

converting a plurality of time domain mixed signals into the time-frequency domain, wherein the time domain mixed signals include signals that have been collected by an array of sensors or transducers, each time domain mixed signal including a mixture of original source signals, thereby generating time-frequency domain mixed signals corresponding to the time domain mixed signals; and performing independent component analysis on the time-frequency domain mixed signals to generate at least one estimated source signal corresponding to at least one of the original source signals, and outputting the at least one estimated source signal, wherein the independent component analysis is performed in conjunction with a moving constraint that models source motion from a direct to reverberant ratio of a source signal and a direction of the source signal, said direct to reverberant ratio obtained from de-mixing filters used in the independent component analysis, and the independent component analysis uses a multivariate probability density function to preserve the alignment of frequency bins in the at least one estimated source signal.

2. The method of claim 1, wherein the time domain mixed signals are audio signals.

3. The method of claim 2, wherein the time domain mixed signals include at least one speech source signal, and the at least one estimated source signal corresponds to said at least one speech signal.

4. The method of claim 3, further comprising converting the time domain mixed signals into digital form with an analog to digital converter before performing a Fourier-related transform.

5. The method of claim 4, wherein the probability density function has a Laplacian distribution.

6. The method of claim 4, wherein the probability density function has a super-Gaussian distribution.

7. The method of claim 3, further comprising performing an inverse STFT on the at least one estimated time-frequency domain source signal to produce at least one estimated time domain source signal corresponding to an original time domain source signal.

8. The method of claim 3, wherein the probability density function has a spherical distribution.

9. The method of claim 3, wherein the probability density function has a multivariate generalized Gaussian distribution.

10. The method of claim 3, wherein the sensor array is a microphone array, and the method further comprises observing the time domain mixed signals with the sensor array before receiving the time domain mixed signals in a signal processing device.

11. The method of claim 1, wherein the multivariate probability density function is a mixed multivariate probability density function that is a weighted mixture of component multivariate probability density functions of frequency bins corresponding to different source signals and/or different time segments.

12. The method of claim 11, wherein said performing independent component analysis comprises utilizing an expectation maximization algorithm to estimate the parameters of the component multivariate probability density functions.

13. The method of claim 12, wherein said performing independent component analysis further comprises utilizing pre-trained eigen-vectors of music and noise.

14. The method of claim 12, wherein said performing independent component analysis further comprises training eigenvectors with run-time data.

15. The method of claim 11, wherein said performing independent component analysis comprises utilizing pre-trained eigen-vectors of clean speech in an estimation of the parameters of the component probability density function.

16. The method of claim 11, wherein said mixed multivariate probability density function is a weighted mixture of component probability density functions of frequency bins corresponding to different sources.

17. The method of claim 11, wherein said mixed multivariate probability density function is a weighted mixture of component probability density functions of frequency bins corresponding to different time segments.

18. The method of claim 1, wherein said performing independent component analysis comprises minimizing or maximizing a cost function that includes a Kullback-Leibler Divergence expression to define independence between source signals and an expression corresponding to said motion constraint.

19. The method of claim 1, wherein said converting the time domain mixed signals into the time frequency domain includes performing a Fourier-related transform, wherein the Fourier-related transform is a short time Fourier transform (STFT) performed over a plurality of discrete time segments.

20. A signal processing device comprising:

a processor;

a memory; and computer coded instructions embodied in the memory and executable by the processor, wherein the instructions are configured to implement a method of signal processing comprising:

converting a plurality of time domain mixed signals into the time frequency domain, wherein the time domain mixed signals include signals that have been collected by an array of sensors or transducers, each time domain mixed signal including a mixture of original source signals, thereby generating time-frequency domain mixed signals corresponding to the time domain mixed signals; and performing independent component analysis on the time-frequency domain mixed signals to generate at least one estimated source signal corresponding to at least one of the original source signals, and outputting the at least one estimated source signal, wherein the independent component analysis is performed in conjunction with a moving constraint that models source motion from a direct to reverberant ratio of a source signal and a direction of the source signal, said direct to reverberant ratio obtained from de-mixing filters used in the independent component analysis, and the independent component analysis uses a multivariate probability density function to preserve the alignment of frequency bins in the at least one estimated source signal.

21. The device of claim 20, further comprising the sensor array.

22. The device of claim 20, wherein the processor is a multi-core processor.

23. The device of claim 20, wherein the sensor array is a microphone array, and the time domain mixed signals are audio signals.

24. The device of claim 23, wherein the time domain mixed signals include at least one speech source signal, and the at least one estimated source signal corresponds to said at least one speech signal.

25. The device of claim 24, wherein the multivariate probability density function is a mixed multivariate probability density function that is a weighted mixture of component multivariate probability density functions of frequency bins corresponding to different source signals and/or different time segments.

26. The device of claim 25, wherein said performing independent component analysis comprises utilizing an expectation maximization algorithm to estimate the parameters of the component multivariate probability density functions.

27. The device of claim 25, wherein said mixed multivariate probability density function is a weighted mixture of component probability density functions of frequency bins corresponding to different sources.

28. The device of claim 25, wherein said mixed multivariate probability density function is a weighted mixture of component probability density functions of frequency bins corresponding to different time segments.

29. The device of claim 24, wherein said performing independent component analysis comprises utilizing pre-trained eigen-vectors of clean speech in an estimation of the parameters of the component probability density functions.

30. The device of claim 29, wherein said performing independent component analysis further comprises utilizing pre-trained eigen-vectors of music and noise.

31. The device of claim 29, wherein said performing independent component analysis further comprises training eigen-vectors with run-time data.

32. The device of claim 24, further comprising an analog to digital converter, wherein said method further comprises converting the time domain mixed signals into digital form with the analog to digital converter before performing a Fourier-related transform.

33. The device of claim 24, further comprising an analog to digital converter, wherein said method further comprises converting the time domain mixed signals into digital form with the analog to digital converter before performing a Fourier-related transform.

34. The device of claim 24, wherein the probability density function has a spherical distribution.

35. The device of claim 34, wherein the probability density function has a super-Gaussian distribution.

36. The device of claim 34, wherein the probability density function has a Laplacian distribution.

37. The device of claim 24, wherein the probability density function has a multivariate generalized Gaussian distribution.

38. The device of claim 20, wherein said performing independent component analysis comprises minimizing or maximizing a cost function that includes a Kullback-Leibler Divergence expression to define independence between source signals and an expression corresponding to said motion constraint.

39. The device of claim 20, wherein said converting the time domain mixed signals into the time frequency domain includes performing a Fourier-related transform, wherein the transform is a short time Fourier transform (STFT) performed over a plurality of discrete time segments.

40. A computer program product comprising a non-transitory computer-readable medium having computer-readable program code embodied in the medium, the program code operable to perform signal processing operations comprising:

converting a plurality of time domain mixed signals into the time-frequency domain, each time domain mixed signal including a mixture of original source signals, wherein the time domain mixed signals include signals that have been collected by an array of sensors or transducers, thereby generating time-frequency domain mixed signals corresponding to the time domain mixed signals; and performing independent component analysis on the time-frequency domain mixed signals to generate at least one estimated source signal corresponding to at least one of the original source signals, and outputting the at least one estimated source signal, wherein the independent component analysis is performed in conjunction with a moving constraint that models source motion from a direct to reverberant ratio of a source signal and a direction of the source signal, said direct to reverberant ratio obtained from de-mixing filters used in the independent component analysis, and the independent component analysis uses a multivariate probability density function to preserve the alignment of frequency bins in the at least one estimated source signal.

* * * * *